US010808934B2

(12) United States Patent
Boardman et al.

(10) Patent No.: US 10,808,934 B2
(45) Date of Patent: Oct. 20, 2020

(54) JET SWIRL AIR BLAST FUEL INJECTOR FOR GAS TURBINE ENGINE

(71) Applicant: General Electric Company, Schenectady, NY (US)

(72) Inventors: Gregory Allen Boardman, Liberty Township, OH (US); Jeffrey Michael Martini, Hamilton, OH (US); Michael Anthony Benjamin, Cincinnati, OH (US); Pradeep Naik, Bangalore (IN)

(73) Assignee: General Electric Company, Schenectady, NY (US)

( * ) Notice: Subject to any disclaimer, the term of this patent is extended or adjusted under 35 U.S.C. 154(b) by 271 days.

(21) Appl. No.: 15/865,809

(22) Filed: Jan. 9, 2018

(65) Prior Publication Data

US 2019/0212009 A1 Jul. 11, 2019

(51) Int. Cl.

| | |
|---|---|
| ***F23R 3/28*** | (2006.01) |
| ***F23R 3/36*** | (2006.01) |
| ***F23R 3/58*** | (2006.01) |
| ***F23R 3/34*** | (2006.01) |
| *F23R 3/14* | (2006.01) |

(52) U.S. Cl.

CPC ..... *F23R 3/286* (2013.01); *F23R 3/283* (2013.01); *F23R 3/346* (2013.01); *F23R 3/36* (2013.01); *F23R 3/58* (2013.01); *F23R 3/14* (2013.01); *F23R 2900/00015* (2013.01)

(58) Field of Classification Search

CPC .. F23R 3/286; F23R 3/28; F23R 3/283; F23R 3/14; F23R 3/346; F23R 3/36; F23R 3/58; F23R 2900/00015

See application file for complete search history.

(56) References Cited

U.S. PATENT DOCUMENTS

| | | | |
|---|---|---|---|
| 2,607,193 | A | 8/1952 | Berggren et al. |
| 8,302,404 | B2 | 11/2012 | Nilsson et al. |
| 8,316,644 | B2 | 11/2012 | Wilbraham |
| 8,707,703 | B2 | 4/2014 | Kim |
| 8,739,545 | B2 | 6/2014 | Cant et al. |
| 8,789,373 | B2 | 7/2014 | Huth |
| 8,806,848 | B2 | 8/2014 | Koizumi et al. |

(Continued)

OTHER PUBLICATIONS

Great Britain Office Action Corresponding to Application No. 1820819 dated Jul. 4, 2019.

*Primary Examiner* — William H Rodriguez

(74) *Attorney, Agent, or Firm* — Dority & Manning, P.A.

(57) ABSTRACT

A fuel injector for a gas turbine engine including an outer sleeve. An upstream end of the outer sleeve defines an inlet opening and a downstream end defines an exit opening, each of which defined within the outer sleeve. The outer sleeve defines a radial opening extended therethrough along the radial direction. At least a portion of the outer sleeve defines a plurality of grooves. The outer sleeve defines a fuel conduit through at least a portion of the outer sleeve outward of the plurality of grooves along the radial direction from the fuel injector centerline. The fuel conduit defines a fuel injection opening inward along the radial direction of the radial opening defined through the outer sleeve. A first member of an arm is coupled to the outer sleeve. A second member of the arm is contoured defining a fuel injection port generally concentric to the fuel injector centerline.

18 Claims, 9 Drawing Sheets

(56) References Cited

U.S. PATENT DOCUMENTS

| | | | | |
|---|---|---|---|---|
| 9,097,425 | B2 | 8/2015 | Hernandez et al. | |
| 9,182,123 | B2 | 11/2015 | Boardman et al. | |
| 9,285,122 | B2 | 3/2016 | Jones et al. | |
| 2004/0250547 | A1* | 12/2004 | Mancini | F23D 11/107 60/740 |
| 2007/0163263 | A1* | 7/2007 | Thomson | F23R 3/283 60/773 |
| 2009/0255262 | A1* | 10/2009 | McMasters | F23R 3/14 60/742 |
| 2009/0256007 | A1* | 10/2009 | McMasters | B23P 6/007 239/463 |
| 2011/0271680 | A1* | 11/2011 | Bagchi | F23R 3/14 60/737 |
| 2012/0131925 | A1* | 5/2012 | Mittricker | F23C 9/00 60/772 |
| 2012/0151929 | A1* | 6/2012 | Patel | F23R 3/28 60/740 |
| 2012/0151930 | A1* | 6/2012 | Patel | F23D 11/383 60/746 |
| 2015/0292743 | A1* | 10/2015 | Mook | F23R 3/14 60/806 |
| 2016/0313007 | A1 | 10/2016 | Martini et al. | |
| 2017/0184309 | A1* | 6/2017 | Turrini | F02C 7/222 |
| 2017/0299190 | A1* | 10/2017 | Patel | F02C 7/22 |
| 2017/0350598 | A1 | 12/2017 | Boardman et al. | |
| 2018/0266692 | A1* | 9/2018 | Patel | F23R 3/28 |
| 2019/0120491 | A1 | 4/2019 | Boardman et al. | |
| 2019/0120493 | A1 | 4/2019 | Boardman et al. | |
| 2019/0271470 | A1* | 9/2019 | Boardman | F23D 14/64 |

* cited by examiner

JET SWIRL AIR BLAST FUEL INJECTOR FOR GAS TURBINE ENGINE

FIELD

The present subject matter relates generally to fuel injectors for combustion assemblies.

BACKGROUND

Gas turbine engines, and particularly combustion assemblies thereof, are increasingly challenged to decrease emissions, increase power output, and improve performance and operability, including at part-load or part-power conditions. However, gas turbine engines are generally limited in weight and space that may be allocated to a combustion assembly.

Potential solutions for improving emissions output, power output, and/or performance and operability are a trapped vortex combustor (TVC) or axially staged combustor assembly. However, known fuel injectors, when applied to TVC or axially staged combustors, generally produce high swirl (e.g., approximately 0.5 or greater swirl number) or relatively low-axial momentum flows of fuel or fuel/oxidizer mixture. Still further, known fuel injectors generally include one or more features promoting flame anchoring, such as flameholders, lobes, centerbodies, or downstream tip structures in general. Although such performance attributes may be appreciable or preferred in conventional lean burn or rich burn annular, can, or can-annular combustor assemblies, such attributes may result in vortex breakdown, centerline reverse flow, and generally inefficient mixing, performance, and operation that are detrimental to TVC or axially staged combustor performance and operation.

As such, there is a need for a fuel injector assembly that produces a relatively high momentum, low swirl or non-swirl fuel/oxidizer flow for driving a trapped vortex or an axially fuel-staged dilution jet.

BRIEF DESCRIPTION

Aspects and advantages of the invention will be set forth in part in the following description, or may be obvious from the description, or may be learned through practice of the invention.

The present disclosure is directed to a fuel injector for a gas turbine engine. The fuel injector includes an at least partially cylindrical outer sleeve extended along a circumferential direction relative to a fuel injector centerline and at least partially co-directional to the fuel injector centerline, wherein an upstream end of the outer sleeve defines an inlet opening and a downstream end of the outer sleeve defines an exit opening, wherein each of the inlet opening and the exit opening are defined within the outer sleeve along a radial direction relative to the fuel injector centerline, and further wherein the outer sleeve defines a radial opening extended therethrough relative to the fuel injector centerline along the radial direction, and wherein at least a portion of an inner diameter of the outer sleeve defines a plurality of grooves extended from approximately the inlet opening, and further wherein the outer sleeve defines a fuel conduit through at least a portion of the outer sleeve outward of the plurality of grooves along the radial direction from the fuel injector centerline, and wherein the fuel conduit defines a fuel injection opening inward along the radial direction of the radial opening defined through the outer sleeve; and an arm coupled to the outer sleeve and extended along the radial direction relative to the fuel injector centerline, wherein the arm defines a first member coupled to the outer sleeve and a second member extended along the radial direction and contoured to define a fuel injection port generally concentric to the fuel injector centerline, and wherein the second member defines a fuel passage extended therethrough in fluid communication with the fuel injection port.

In one embodiment, the second member of the arm defines a pressure atomizer within the fuel passage.

In another embodiment, the outer sleeve defines at least a portion of the inner diameter at the plurality of grooves as decreasing from the inlet opening toward the downstream direction.

In still another embodiment, the radial opening defined through the outer sleeve is disposed outward along the radial direction of a downstream end of the plurality of grooves.

In yet another embodiment, the radial opening defined through the outer sleeve is extended at least partially along the circumferential direction relative to the fuel injector centerline.

In still yet another embodiment, a fuel/oxidizer mixing passage is defined inward of the outer sleeve. The fuel/oxidizer mixing passage is defined downstream of the plurality of grooves and upstream of the exit opening.

In one embodiment, the fuel conduit is further defined through the first member of the arm.

In another embodiment, the radial opening through the outer sleeve is extended at least partially along an axial direction relative to the fuel injector centerline. A fuel injection opening and a downstream end of the plurality of grooves are each defined inward of the radial opening along the radial direction.

In various embodiments, the fuel injector further includes a forward wall extended along the radial direction between the outer sleeve and the second member of the arm. The forward wall is generally concentric to the fuel injector centerline and defines a plurality of wall openings therethrough. In one embodiment, the wall opening is defined through the forward wall extended at least partially in the circumferential direction relative to the fuel injector centerline.

Another aspect of the present disclosure is directed to a gas turbine engine defining an axial engine centerline. The gas turbine engine includes a combustion section defined generally concentric to the engine centerline. The combustion section includes a plurality of fuel injectors defines in adjacent circumferential arrangement around the engine centerline.

In one embodiment of the engine, the combustion section defines a trapped vortex combustor assembly.

In another embodiment of the engine, the plurality of fuel injectors is disposed at least partially in a circumferential direction relative to the engine centerline.

In still another embodiment of the engine, the plurality of fuel injectors is disposed at least partially in a radial direction relative to the engine centerline.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
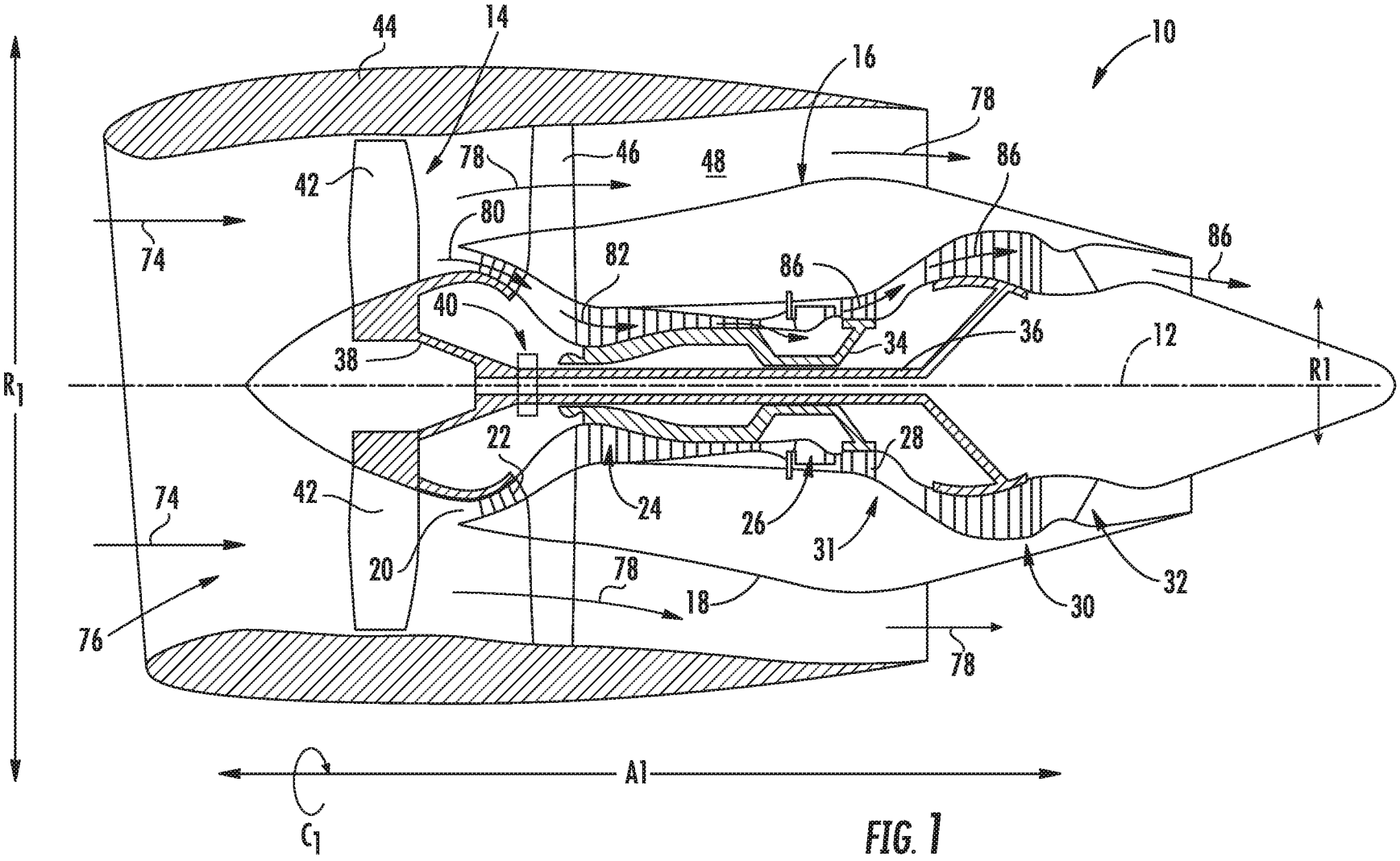
FIG. 1 is a schematic cross sectional view of an exemplary gas turbine engine incorporating an exemplary embodiment of a combustor assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a fuel injector assembly that produces a relatively high momentum, low swirl or non-swirl fuel/oxidizer flow for driving a trapped vortex or an axially fuel-staged dilution jet are generally provided. Various embodiments of the fuel injector generally provided herein may define a swirl number at the downstream end of the fuel injector less than approximately 0.5. The low- or non-swirled flow of fuel and oxidizer from the fuel injector prevents vortex breakdown in trapped vortex combustion (TVC) assemblies. Still further, the low- or non-swirled flow fuel and oxidizer from the fuel injector may further prevent centerline reverse flow. Furthermore, the fuel injector provides an internal shear structure to promote rapid mixing of fuel from one or more fuel injection ports/openings with oxidizer egressed through the one or more oxidizer openings. The embodiments of the fuel injector may improve performance and operability of TVC or fuel-staged combustor assemblies, thereby improving gas turbine engine performance, operability, emissions output, and power output.

Referring now to the drawings, FIG. 1 is a schematic partially cross-sectioned side view of an exemplary gas turbine engine defining a high by-pass turbofan engine 10 herein referred to as "engine 10" as may incorporate various embodiments of the present disclosure. Although further described below with reference to a turbofan engine, the present disclosure is also applicable to gas turbine engines in general, including turbomachinery in general such as turbojet, turboprop, and turboshaft gas turbine engines, including marine and industrial turbine engines and auxiliary power units. The present disclosure is further applicable to propulsion systems for apparatuses including rockets, missiles, etc., such as ramjets, scramjets, etc. The engine 10 generally defines an axial direction A1, a radial direction R1 relative to an axial centerline axis 12 extended there through for reference purposes, and a circumferential direction C1 extended relative to the centerline axis 12. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section 31 including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
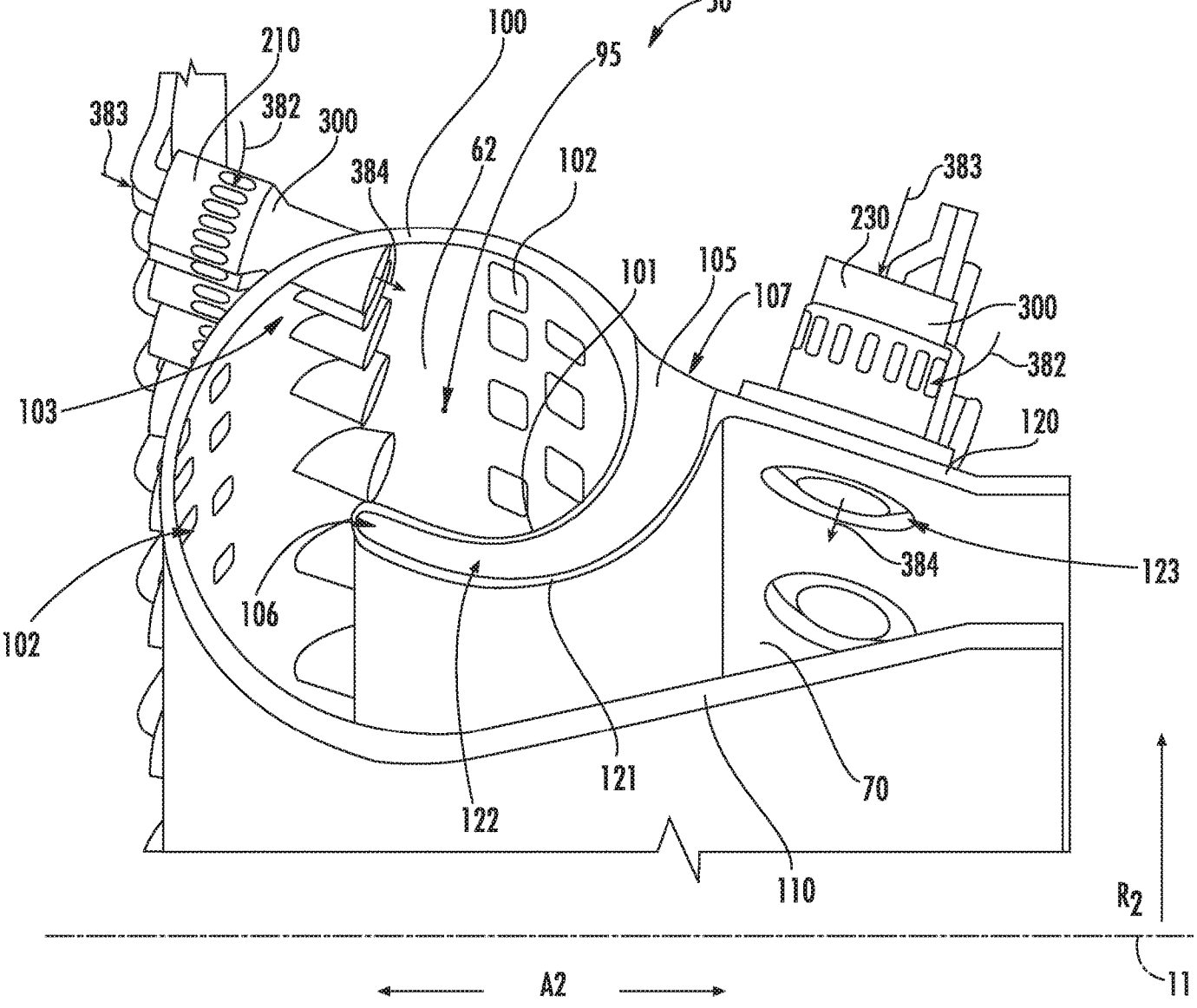
FIG. 2 is an axial cross sectional view of an exemplary embodiment of a combustor assembly of the combustion section of the gas turbine engine generally provided in FIG. 1.

Referring now to FIG. 2, an axial cross sectional view of a combustor assembly 50 of the combustion section 26 is generally provided. The combustor assembly 50 includes a volute wall 100 extended annularly around a combustor centerline 11. The volute wall 100 is extended at least partially as a spiral curve from a circumferential reference line 95 around the combustor centerline 11. The volute wall 100 defines a combustion chamber 62 inward of the volute wall 100. An annular inner wall 110 is extended at least partially along an axial direction A2 from the volute wall 100. An annular outer wall 120 is extended at least partially along the axial direction A2 from the volute wall 100. The inner wall 110 and the outer wall 120 are separated along a radial direction R2 from the combustor centerline 11. A primary flow passage 70 is defined between the inner wall 110 and the outer wall 120 in fluid communication from the combustion chamber 62.

It should be appreciated that in various embodiments, the combustor centerline 11 may be the same as the axial centerline 12 of the engine 10. However, in other embodiments, the combustor centerline 11 may be disposed at an acute angle relative to the axial centerline 12. Still further, the combustor centerline 11 may be disposed at a tangent relative to the axial centerline 12. As such, in various embodiments, the axial direction A2 may be the same as the axial direction A1 or generally co-directional or co-planar. However, in other embodiments, the axial direction A2 is defined relative to the disposition of the combustor centerline 11, such as co-directional, which may be defined at a different direction relative to the axial direction A1 of the engine 10.

In various embodiments, the combustor assembly 50 further includes a primary fuel injector 210. The volute wall 100 defines one or more fuel injection openings 103 through which the primary fuel injector 210 is extended at least partially into the combustion chamber 62. In one embodiment, a reference chord 96 is defined from the volute wall 100. The primary fuel injector 210 is extended at least partially into the combustion chamber 62 at an acute angle 97 relative to the reference chord 96.

In another embodiment, the primary fuel injector 210 is extended at least partially into the combustion chamber 62 at a tangent angle relative to the volute wall 100 and the combustor centerline 11. For example, the primary fuel injector 210 may be disposed at a tangent angle such that a flow of liquid or gaseous fuel is deposited into the combustion chamber 62 at least partially along a circumferential direction C2 relative to the combustor centerline 11 (shown in FIG. 3) within the combustion chamber 62.

In still various embodiments, the primary fuel injector 210 may extend at least partially into the combustion chamber 62 at a compound angle of axial, radial, and azimuthal components relative to the combustion chamber 62.

In various embodiments, the primary fuel injector 210 deposits a flow of liquid or gaseous fuel into the combustion chamber 62 to define a primary combustion zone 61 within the combustion chamber 62. In still various embodiments, the primary fuel injector 210 and the combustion chamber 62 define an annular trapped vortex or toroidally stabilized primary combustion zone 61. The trapped vortex primary combustion zone 61 may be defined stoichiometrically lean or rich. In one embodiment, the fuel at the combustion chamber 62 from the primary fuel injector 210 may be premixed with oxidizer. In another embodiment, the fuel and oxidizer may be separate (i.e., diffusion). In still various embodiments, a combination of diffuser and premixed fuel/oxidizer may enter the primary combustion zone 61 defined in the combustion chamber 62.

Figure 3:
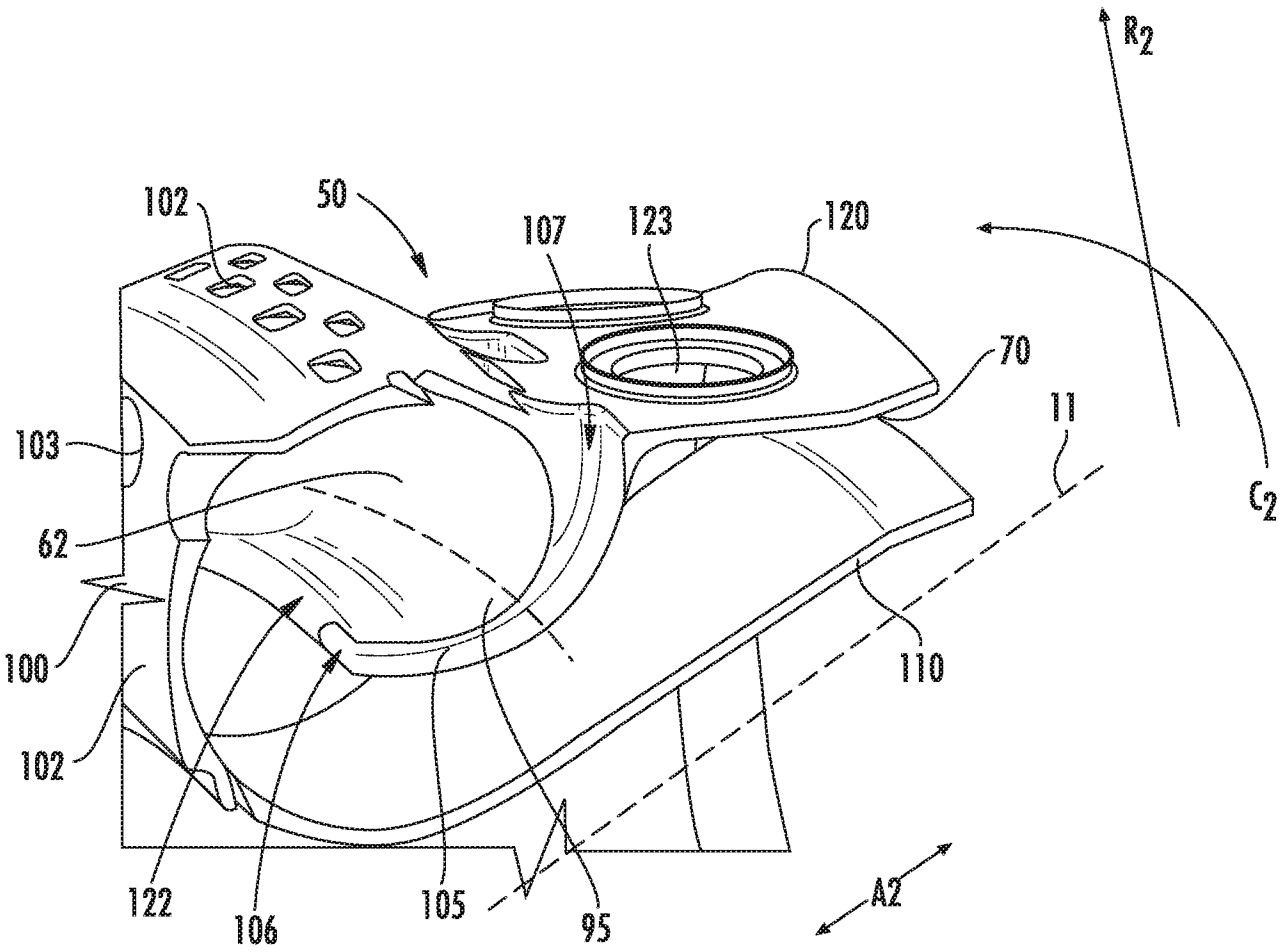
FIG. 3 is a perspective view of a portion of an exemplary embodiment of a combustor assembly generally provided in FIG. 2.

Referring now to FIG. 3, a perspective view of a portion of the combustor assembly 50 of FIG. 2 is generally provided. Referring to FIGS. 2-3, a portion 101 of the volute wall 100 and a portion 121 of the outer wall 120 together define a secondary flow passage 105 therebetween. The volute wall 100 and the outer wall 120 together define one or more secondary outlet openings 106 adjacent to the combustion chamber 62. The second outlet opening 106 is in fluid communication with the primary flow passage 70. In one embodiment, the second outlet opening 106 is more specifically in fluid communication with the combustion chamber 62. The outer wall 120 further defines one or more secondary inlet openings 107 in fluid communication with the secondary flow passage 105 and the secondary outlet opening 106.

In one embodiment of the combustor assembly 50, the secondary flow passage 105 is extended at least partially annularly relative to the combustor centerline 11. In other embodiments, such as generally shown in FIG. 3, a secondary flow passage wall 122 is extended to the portion 101 of the volute wall 100 and the portion 121 of the outer wall 120. The secondary flow passage wall 122, the portion 101 of the volute wall 100, and the portion 121 of the outer wall 120 together define the secondary flow passage 105 as a discrete passage. The secondary flow passage wall 122 defines two or more discrete secondary flow passages 105 in an adjacent circumferential arrangement around the combustor centerline 11.

In one embodiment, the annular trapped vortex primary combustion zone 61 within the combustion chamber 62 is disposed generally outward along the radial direction R2 relative to the primary flow passage 70 extended between the inner wall 110 and the outer wall 120. For example, the combustion chamber 62 is generally stacked and at least partially partitioned from the primary flow passage 70 via the portions 101, 121 of the volute wall 100 and the outer wall 120 extended to define the secondary flow passage 105.

Referring back to FIG. 2, in various embodiments, the secondary flow passage 105 defines a decreasing cross sectional area from approximately the secondary inlet opening 107 to approximately the secondary outlet opening 106. The decreasing cross sectional area may generally define a nozzle accelerating a flow of fluid through the secondary flow passage 105 to the combustion chamber 62. In various embodiments, the flow of fluid is a liquid or gaseous fuel (further described below), a flow of oxidizer (e.g., air), or a flow of inert gas or combinations thereof.

In one embodiment, the secondary flow passage 105, at least in part, may provide a flow of oxidizer to help define at least one passage providing a flow of oxidizer to the volute combustion chamber 62 helping to drive the trapped vortex or toroidal stabilization of the primary combustion zone 61 at the combustion chamber 62.

In another embodiment, such as further discussed below, the combustor assembly 50 further defines one or more fuel injection locations downstream of the primary combustion zone 61 at the combustion chamber 62, such as between the trapped vortex primary combustion zone 61 and a downstream exit of the combustor assembly 50. Similarly as the primary fuel injector 210 and the primary combustion zone 61, the one or more downstream fuel injection locations may be defined as stoichiometrically lean or rich, or combinations thereof. Still further, the one or more fuel injection locations may define a diffusion or premixed fuel and oxidizer, or combinations thereof. In various embodiments, the downstream fuel injector locations further discussed below may be defined as actively-controlled fueled dilution of combustion gases exiting the combustor assembly 50. In still various embodiments, the primary fuel injector 210, one or more of the downstream fuel injectors (e.g., secondary fuel injector 220, tertiary fuel injector 230), or combinations thereof, may be controlled to selectively provide fuel or fuel/oxidizer mixture 384 to the combustion chamber 62, the primary flow passage 70, or both, to provide a desired residence time of the fuel/oxidizer mixture 384 when forming the combustion gases 86.

Figure 4:
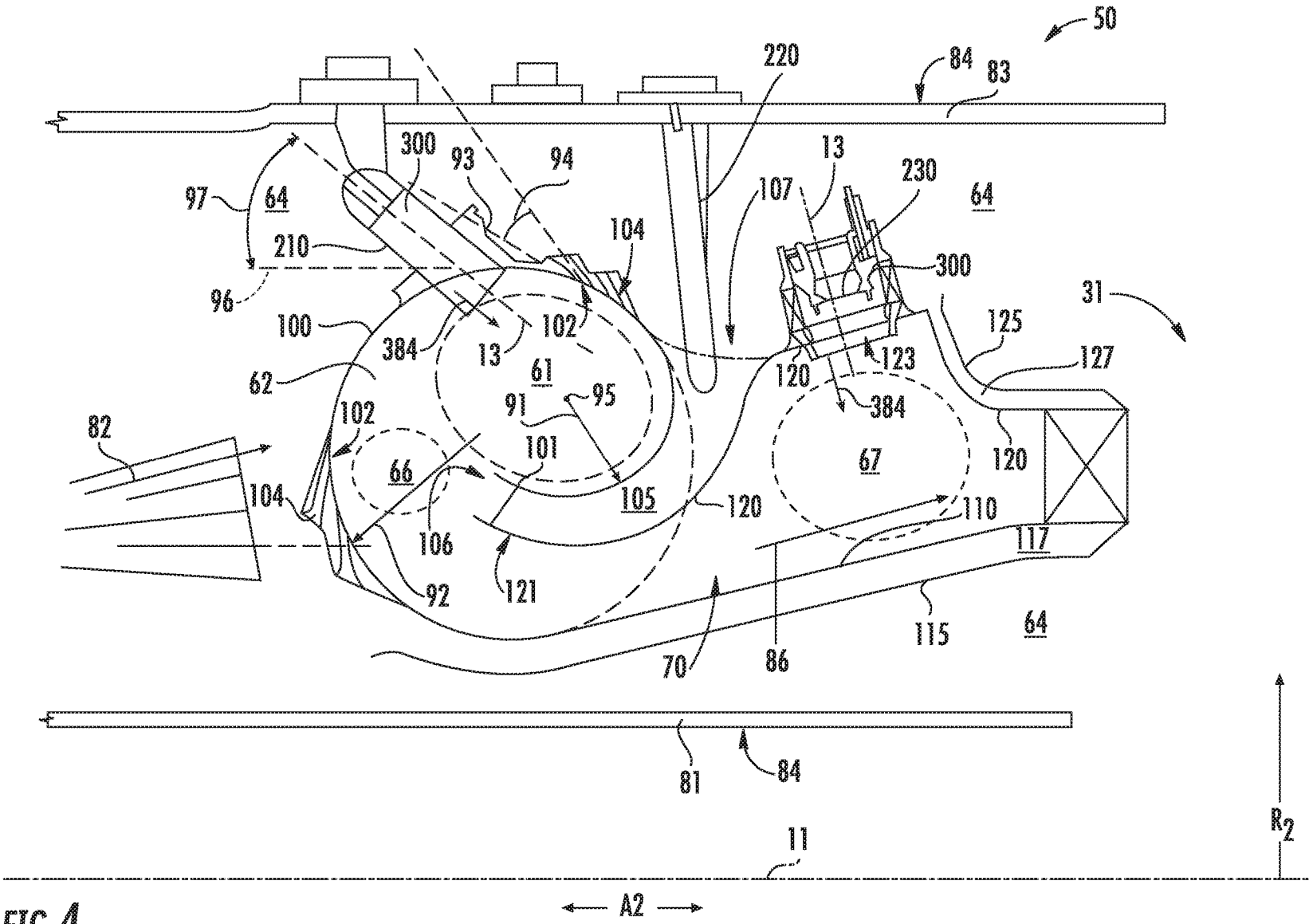
FIG. 4 is a cross sectional view of another exemplary embodiment of the combustor assembly generally provided in FIG. 2.

Referring now to FIG. 4, an axial cross sectional view of the combustion section 26 is generally provided. In the embodiment shown in FIG. 4, the combustor assembly 50 may further include a secondary fuel injector 220 extended at least partially into the secondary flow passage 105 through the secondary inlet opening 107. The secondary fuel injector 220 is configured to deposit a flow of liquid or gaseous fuel into the secondary flow passage 105 to egress into the combustion chamber 62. As such, the secondary flow passage 105 in fluid communication with the primary flow passage 70, or more specifically, the combustion chamber 62, defines a secondary fuel/oxidizer injection port generally downstream (along the primary flow passage 70) of the primary fuel injector 210. The secondary flow passage 105 may egress a fuel into the combustion chamber 62 to mix and ignite to form a secondary combustion zone downstream of the primary combustion zone 61, such as shown schematically at circle 66.

Referring still to FIG. 4, in various embodiments of the combustor assembly 50, the volute wall 100 extends from a first radius 91 disposed approximately at the secondary outlet opening 106 to a second radius 92 disposed approximately at the inner wall 110. The second radius 92 is generally greater than the first radius 91. As such, the volute wall 100 may generally define a scroll wall defining an annular volute combustion chamber 62.

Referring now to FIGS. 2 and 4, the combustor assembly 50 may further define a tertiary opening 123 through the outer wall 120. The tertiary opening 123 is defined adjacent to the primary flow passage 70. For example, the tertiary opening 123 is generally downstream of the combustion chamber 62. More specifically, the tertiary opening 123 may be defined through the outer wall 120 downstream of the secondary outlet opening 106.

In various embodiments, the combustor assembly 50 further includes a tertiary fuel injector 230 extended at least partially through the tertiary opening 123 at the outer wall 120. In one embodiment, the tertiary fuel injector 230 is extended at least partially at a tangent angle relative to the outer wall 120 and the combustor centerline 11, such as to deposit a flow of liquid or gaseous fuel at least partially along the circumferential direction C2 (shown in FIG. 3) relative to the combustor centerline 11. The tertiary fuel injector 230 may egress a flow of fuel into the primary flow passage 70 to mix and ignite to form a tertiary combustion zone downstream of the primary combustion zone 61, such as shown schematically at circle 67.

Referring now to FIGS. 2-4, in various embodiments, the volute wall 100 defines one or more volute wall openings 102 therethrough in fluid communication with the combustion chamber 62. The volute wall openings 102 permit a flow of oxidizer into the combustion chamber 62 to drive the trapped vortex therewithin. In one embodiment, the vortex-driving oxidizer may be premixed with a fuel separate from the primary fuel injector 210 such as to create an at least partially premixed hybrid trapped vortex zone in the combustion chamber 62.

Referring now to FIG. 4, in still various embodiments, the volute wall 100 defines a volute wall passage 104 extended to the volute wall opening 102. The volute wall passage 104 is extended from a diffuser cavity or pressure plenum 64 (e.g., compressor exit pressure or P3) surrounding the volute wall 100, the inner wall 110, and the outer wall 120. In one embodiment, a second reference chord 93 is defined from the volute wall 100. The volute wall 100 defines the volute wall passage 104 at an acute angle 94 relative to the reference chord 96. In another embodiment, the volute wall passage 104 may define a decreasing cross sectional area from the pressure plenum 64 to the combustion chamber 62 such as to accelerate a flow of oxidizer into the combustion chamber 62. The accelerated flow of oxidizer and/or the acute angle 94 at which the flow of oxidizer enters the combustion chamber 62 may further promote toroidal stabilization of the combustion gases at the primary combustion zone 61 within the combustion chamber 62.

Referring still to FIG. 4, the combustor assembly 50 may further include a second inner wall 115 disposed inward of the inner wall 110 along the radial direction R2. The second inner wall 115 is extended at least partially along the axial direction A2. An inner cooling flow passage 117 is defined between the second inner wall 115 and the inner wall 110. The inner cooling flow passage 117 provides a flow of oxidizer from the pressure plenum 64 to downstream of the combustor assembly 50. For example, the inner cooling flow passage 117 may provide a flow of oxidizer from the pressure plenum 64 to a turbine nozzle of a turbine section 31. The inner cooling flow passage 117 may further define fins or nozzles, or varying cross sectional areas, such as to define an inducer accelerating a flow of oxidizer toward the downstream end. The accelerated flow of oxidizer may further provide thermal attenuation or heat transfer to at least one of the inner wall 110, the second inner wall 115, or a downstream component of the engine 10 (e.g., turbine nozzle, turbine rotor, turbine secondary flowpath, etc.).

In another embodiment, the combustor assembly 50 may further include a second outer wall 125 disposed outward of the outer wall 120 along the radial direction R2. The second outer wall 125 is extended at least partially along the axial direction A2. An outer cooling flow passage 127 is defined between the outer wall 120 and the second outer wall 125. Similarly as described in regard to the inner cooling flow passage 117, outer cooling flow passage 127 provides a flow of oxidizer from the pressure plenum 64 toward downstream of the combustor assembly 50. For example, the outer cooling flow passage 127 may provide a flow of oxidizer from the pressure plenum 64 to a turbine nozzle of a turbine section 31. The outer cooling flow passage 127 may further define fins or nozzles, or varying cross sectional areas, such as to define an inducer accelerating a flow of oxidizer toward the downstream end.

In various embodiments, one or more of the volute wall 100, or the inner wall 110, the outer wall 120 may include a plurality of orifices therethrough to enable a portion of oxidizer to flow from the secondary flow passage 105, the inner cooling passage 117, or the outer cooling passage 127, respectively, or the pressure plenum 64 into the primary flow passage 70, such as to adjust or affect an exit temperature profile, or circumferential distribution thereof (e.g., pattern factor). The orifices may define dilution jets, cooling nuggets or louvers, holes, or transpiration. In still various embodiments, the plurality of orifices may provide thermal attenuation (e.g., cooling) to one or more of the volute wall 100, the inner wall 110, or the outer wall 120.

Referring still to FIG. 4, the combustor assembly 50 may further include a pressure vessel or diffuser case 84 surrounding the volute wall 100, the inner wall 110, and the outer wall 120. The diffuser case 84 includes an inner diffuser wall 81 defined inward of the inner wall 110 and the volute wall 100 along the radial direction R2. An outer diffuser wall 83 is defined outward of the outer wall 120 and the volute wall 100 along the radial direction R2. The diffuser case 84 is extended at least partially along the axial direction A2 or along the axial direction A1. The diffuser case 84 defines the pressure plenum 64 surrounding the volute wall 100, the outer wall 120, and the inner wall 110.

Figure 5:
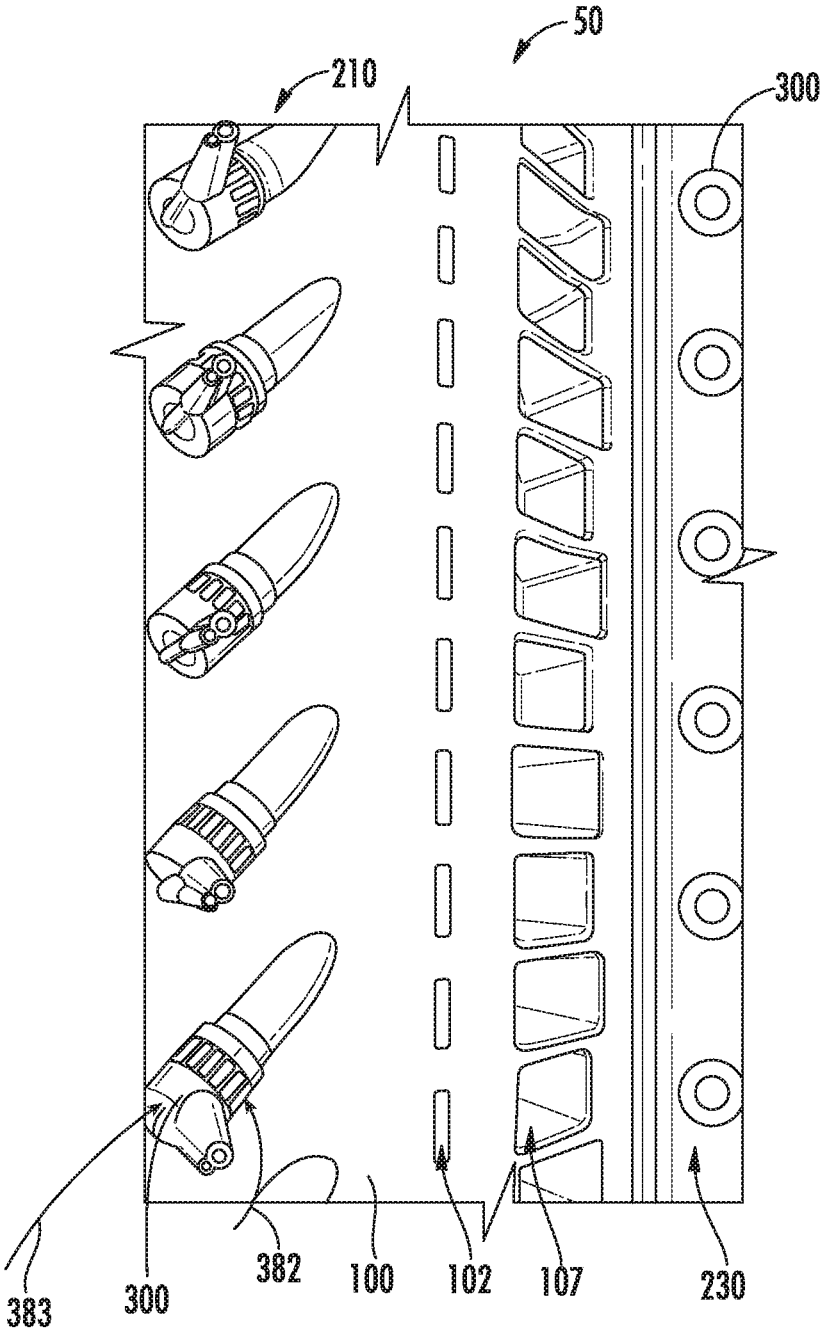
FIG. 5 is a side view of an exemplary embodiment of the combustor assembly generally provided in FIG. 2.
Figure 6:
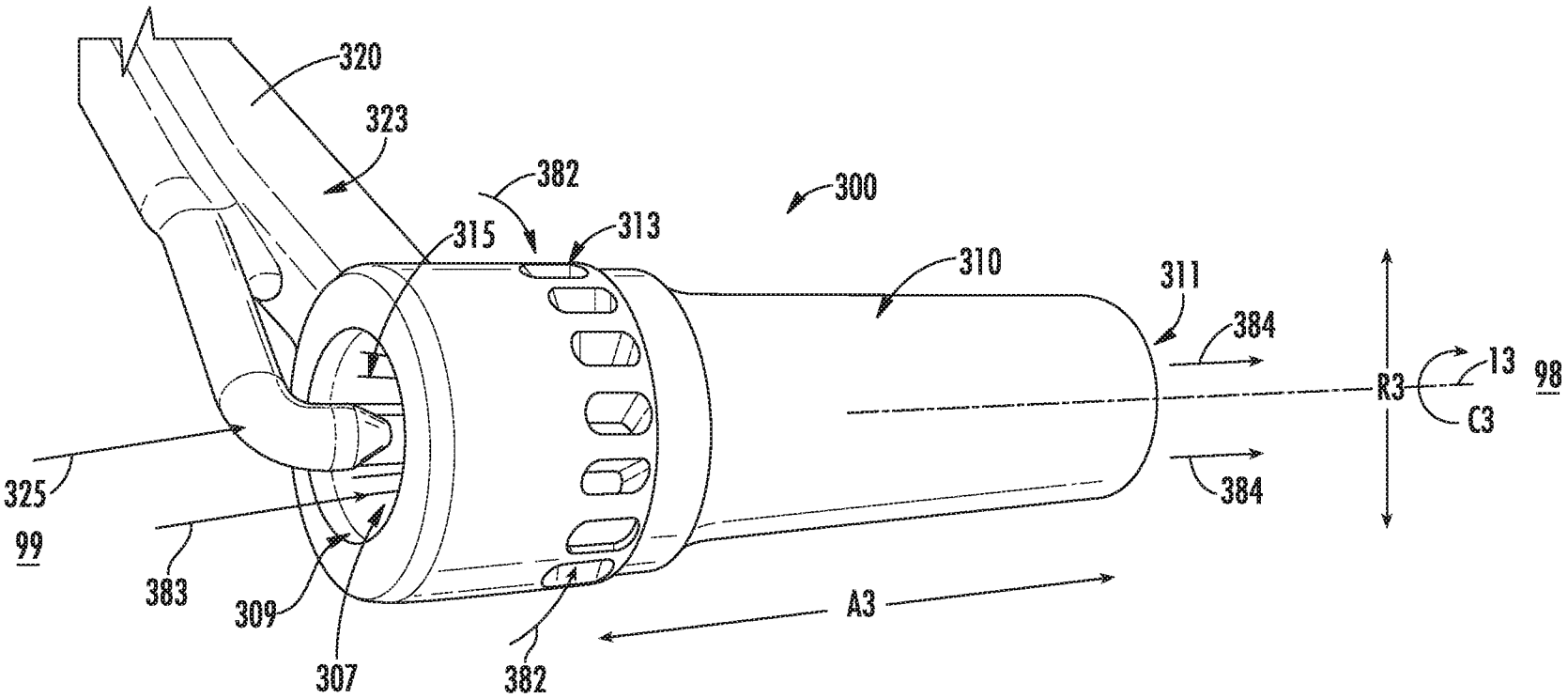
FIG. 6 is a perspective view of an exemplary embodiment of a fuel injector of the combustor assembly of FIG. 2.
Figure 7:
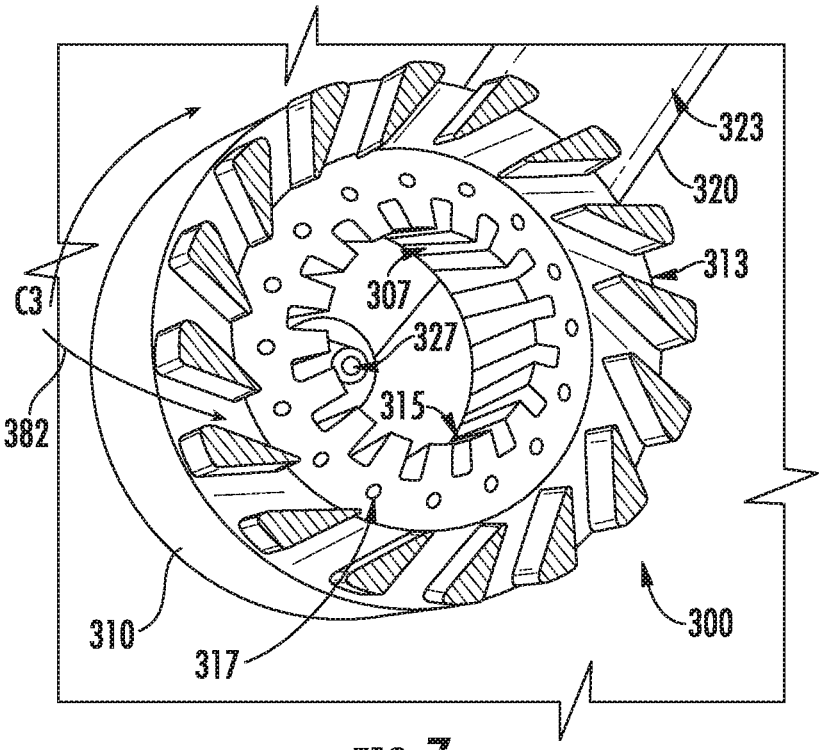
FIG. 7 is a cutaway view of the exemplary fuel injector of FIG. 6 at plane A-A shown in FIG. 9.

Referring now to FIG. 5, a side view of an exemplary embodiment of the combustor assembly 50 generally shown and described in various embodiments of FIGS. 1-4 is generally provided. The embodiment generally provided in FIG. 5 further depicts the plurality of primary fuel injector 210 disposed at a tangent angle relative to the combustor centerline 11. In various embodiments, the primary fuel injector 210 may further be disposed at the acute angle 97 such as described in regard to FIGS. 2-4.

In one embodiment, such as generally provided in FIG. 5, the tertiary fuel injector 230 may be disposed approximately along the radial direction R2 relative to the combustor centerline 11. In other embodiments, the tertiary fuel injector 230 may be disposed at least partially along the circumferential direction C2 or tangentially relative to the combustor centerline 11.

Although not further depicted in FIG. 5, the combustor assembly 50 generally provided may include the secondary fuel injector 220 disposed at least partially through one or more of the secondary inlet opening 107 at least partially along the radial direction R2 to provide a flow of fuel to produce the secondary combustion zone 66 generally shown in FIG. 4.

In still various embodiments, one or more of the primary fuel injector 210, the secondary fuel injector 220, or the tertiary fuel injector 230 may define a fuel injector 300 shown and described further in regard to FIGS. 6-11.

During operation of the engine 10, as shown in FIGS. 1-5 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26.

As shown in FIG. 2 and FIG. 5, the now compressed air as indicated schematically by arrows 82 flows through the combustor assembly 50. A liquid or gaseous fuel is deposited into the combustion chamber 62 via the primary fuel injector 210. The fuel and compressed air 82 are mixed and burned to produce combustion gases 86 (shown in FIG. 1). More specifically, the fuel and air are mixed and ignited in the combustion chamber 62 at the primary combustion zone 61 and toroidally stabilized via the compressed air 82 entering the combustion chamber 62 via the secondary flow passage 105 through the secondary inlet opening 107, the volute wall openings 102, or both. In various embodiments, such as shown in FIG. 3, the secondary fuel injector 220 provides additional fuel through the secondary flow passage 105 to further mix with air and combustion gases downstream of the primary combustion zone 61. The combustion gases then flow through the primary flow passage 70 toward the turbine section 31. In various embodiments, the combustor assembly 50 including the tertiary fuel injector 230 further deposits fuel to the primary flow passage 70 to mix with the combustion gases 86 downstream of the primary combustion zone 61.

Referring still to FIGS. 1-5, the combustion gases 86 generated in the combustion chamber 62 flow from the volute wall 100 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

It should be appreciated that, in various embodiments, openings generally defined herein, such as, but not limited to, the volute wall opening 102, the secondary outlet opening 106, the secondary inlet opening 107, and one or passages, such as, but not limited to, the volute wall passage 104 and the secondary flow passage 105, the inner cooling flow passage 117, and the outer cooling flow passage 127, may each define one or more cross sectional areas including, but not limited to racetrack, circular, elliptical or ovular, rectangular, star, polygonal, or oblong, or combinations thereof. Still further, the aforementioned passages may define variable cross sectional areas, such as decreasing, increasing, or combination thereof, such as convergent/divergent. The variable cross sectional areas may define features providing an accelerated flow, changes in pressure, or changes in orientation of flow, such as along a circumferential direction, radial direction, or axial direction, or combinations thereof.

Referring now to FIGS. 6-11, embodiments of the primary fuel injector 210, the secondary fuel injector 220, and the tertiary fuel injector 230 are generally provided (hereinafter referred to collectively as "fuel injector 300"). The fuel injector 300 defines an axial direction A3 extended co-directional to a fuel injector centerline 13. A circumferential direction C3 is defined around the fuel injector centerline 13 and a radial direction R3 is extended from the fuel injector centerline 13. Axial direction A3 is defined independently of axial directions A1 and A2 further described herein. The fuel injector 300 further defines an upstream end 99 and a downstream end 98 provided for reference to generally indicate a direction of flow through the fuel injector 300.

The fuel injector 300 includes an at least partially cylindrical outer sleeve 310 extended along the circumferential direction C3. The outer sleeve 310 is further extended at least partially co-directional to the fuel injector centerline 13 along the axial direction A3. The upstream end 99 of the outer sleeve 310 defines an inlet opening 309. The downstream end 98 of the outer sleeve 310 defines an exit opening 311. Each of the inlet opening 309 and the exit opening 311 are defined within the outer sleeve 310 along the radial direction R3. The outer sleeve 310 defines a radial opening 313 extended therethrough relative to the fuel injector centerline 13 along the radial direction R3. At least a portion of an inner diameter 307 of the outer sleeve 310 defines a plurality of grooves 315 extended from approximately the inlet opening 309. A fuel/oxidizer mixing passage 305 is defined inward of the outer sleeve 310 along the radial direction R3. The fuel/oxidizer mixing passage 305 is further defined downstream of the plurality of grooves 315 and upstream of the exit opening 311.

Figure 8:
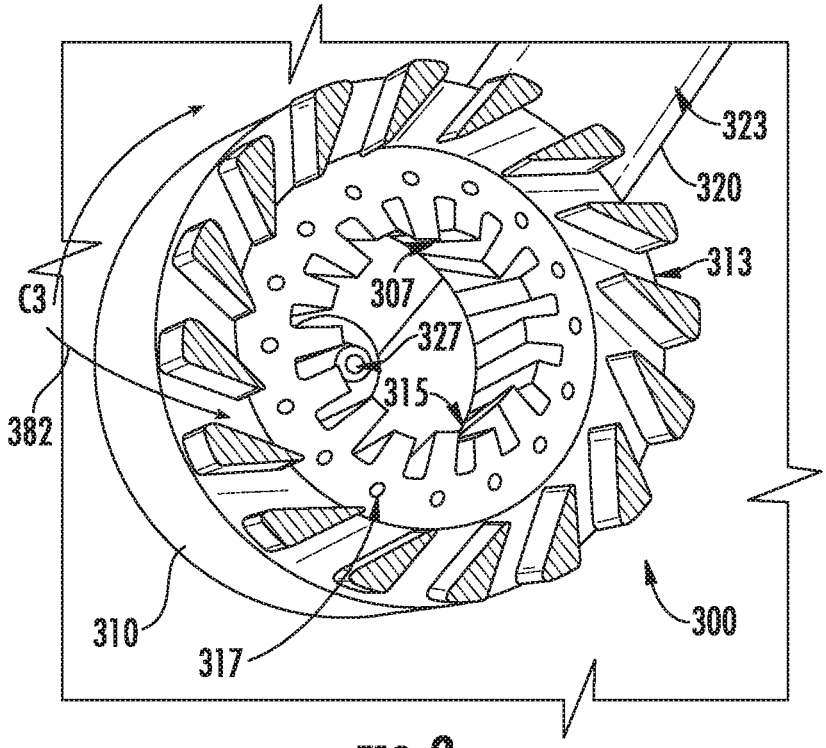
FIG. 8 is a cutaway view of another exemplary embodiment of the fuel injector of FIG. 6 at plane A-A shown in FIG. 9.
Figure 9:
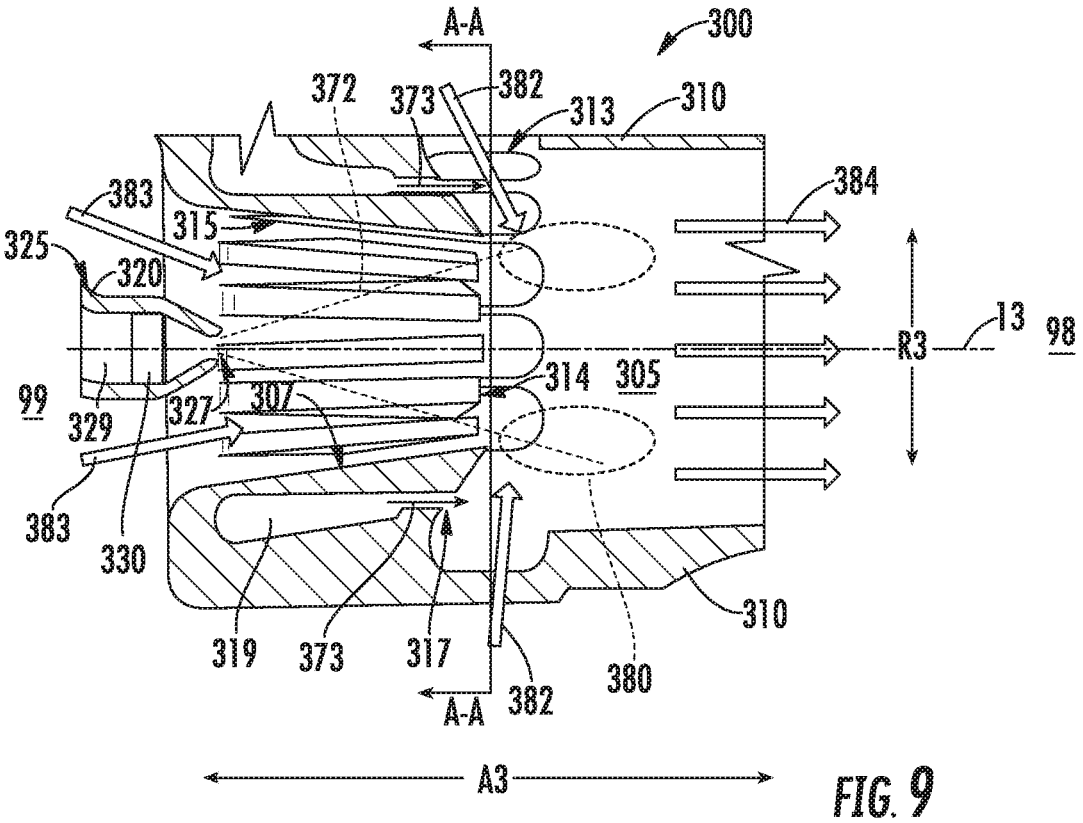
FIG. 9 is a cross sectional view of a portion of the exemplary fuel injector of FIG. 6.

In various embodiments, such as generally provided in regard to FIG. 8, a portion of the plurality of grooves 315 may extend inward along the radial direction R3 more than others of the plurality of grooves 315. More example, ridges or teeth defining the grooves 315 may alternatively extend inward along the radial direction R3 more than others. In the embodiment generally provided in FIG. 8, every other groove 315 is extended further than the other. However, in other embodiments, the grooves 315 may extend more or less along the radial direction R3, or in asymmetric arrangement relative to the fuel injector centerline 13. Still further, an angle along the inner diameter 307 from the inlet opening 309 to the downstream end 314 of the plurality of grooves 315 may differ among the plurality of grooves 315. The angle may be generally acute and vary among the plurality of grooves 315.

The outer sleeve 310 defines a fuel conduit 319 through at least a portion of the outer sleeve 310 radially outward of the plurality of grooves 315. The fuel conduit 319 defines a fuel injection opening 317 inward along the radial direction R3 of the radial opening 313 defined through the outer sleeve 310.

The fuel injector 300 further includes an arm 320 coupled to the outer sleeve 310. The arm 320 is extended along the radial direction R3 relative to the fuel injector centerline 13. The arm 320 defines a first member 323 coupled to the outer sleeve 310. The arm 320 further defines a second member 325 extended along the radial direction R3 and contoured to define a fuel injection port 327 generally concentric to the fuel injector centerline 13. The second member 325 defines a fuel passage 329 extended therethrough in fluid communication with the fuel injection port 327.

Embodiments of the fuel injector 300 generally provided herein may generally provide a low swirl or non-swirled mixture of fuel and oxidizer to the combustion chamber 62, the primary flow passage 70, or, more specifically, one or more of the primary combustion zone 61, the secondary combustion zone 66, or the tertiary combustion zone 67. Various embodiments of the fuel injector 300 described herein provide a swirl number of the fuel/oxidizer mixture 384 more suitable for TVC or staged combustion assemblies. Swirl number is a measure of intensity of angular momentum of a fluid (e.g., fuel/oxidizer mixture 384 relative to the fuel injector centerline 13) defined as a ratio of axial flux of angular momentum to axial flux of axial momentum. Various embodiments of the fuel injector 300 generally provided herein may define a swirl number at the downstream end of the fuel injector 300 (e.g., at the exit opening 311) less than approximately 0.5. In one embodiment, the fuel injector 300 defines a swirl number at the exit opening 311 between approximately 0.2 and approximately 0.3. The low- or non-swirled flow of fuel and oxidizer from the fuel injector 300 prevents vortex breakdown in trapped vortex combustion (TVC) assemblies, such as the embodiments generally shown and described in regard to FIGS. 2-5. Still further, the low- or non-swirled flow fuel and oxidizer from the fuel injector 300 may further prevent centerline reverse flow (e.g., along fuel injector centerline 13). Furthermore, the outer sleeve 310, such as defining the plurality of grooves 315, provides an internal shear structure to promote rapid mixing of fuel from the fuel injection port 327, the fuel injection opening 317, or both, with oxidizer egressed through the inlet opening 309, the radial opening 313, or both.

Embodiments of the fuel injector 300 generally provided herein may further provide a high momentum flow of fuel and oxidizer to the combustion chamber 62, the primary flow passage 70, or both, such as to provide axially staged (e.g., aft or downstream staged) fuel injection such as to improve power output, to improve emissions output, and to improve performance and operability. The relatively high momentum flow of fuel and oxidizer mixture to the combustion chamber 62, the primary flow passage 70, or both, (e.g., such as shown and described in regard to the secondary fuel injector 220, the tertiary fuel injector 230, or both) may provide fuel/oxidizer mixture 384 for a fuel-staged dilution jet combustor assembly while mitigating or eliminating a recirculation zone.

Still further, embodiments of the fuel injector 300 generally provided herein mitigate flameholding or anchoring, such as via a centerbody-less structure (i.e., absent of a generally cylindrical structure extended substantially or completely down a fuel/oxidizer mixing flowpath), or lobes, flameholders, or tip structures generally within or downstream of a fuel/oxidizer mixing passage. For example, the fuel/oxidizer mixing passage 305 is defined within the hollow outer sleeve 310 without structures disposed within the fuel/oxidizer mixing passage 305 that may otherwise promote flameholding or anchoring.

Embodiments of the fuel injector 300 generally provided herein may be disposed in circumferential arrangement within the combustor assembly 50, such as generally shown and described in regard to the primary fuel injector 210 (e.g., FIG. 2, FIG. 5). In such an embodiment, the fuel injector 300, defining the primary fuel injector 210, provides a premixed jet swirled air blast mixture of fuel and oxidizer to the combustion chamber 62 to drive a trapped vortex flow of the TVC. In various embodiments, the fuel injector 300, defining the primary fuel injector 210, may be disposed at the acute angle 97, such as described herein in regard to FIGS. 2-5. In still various embodiments, the fuel injector 300, defining the primary fuel injector 210, may be disposed at least partially along the circumferential or tangential direction through the outer wall 120 (e.g., FIG. 5). For example, the circumferential or tangential direction is generally relative to the circumferential reference line 95 extended through the combustion chamber 62.

Furthermore, embodiments of the fuel injector 300 generally provided herein may be disposed in circumferential arrangement within the combustor assembly 50, such as generally shown and described in regard to the secondary fuel injector 220 and the tertiary fuel injector 230. In such embodiments, the fuel injector 300 may provide a fuel/oxidizer dilution jet mixture to generally mitigate or eliminate formation of a recirculation zone within the primary flow passage 70.

Still further, in various embodiments of the fuel injector 300, the outer sleeve 310 is extended along the axial direction A3 based at least on a desired period of time of fuel/oxidizer mixing (e.g., premixing) within the fuel/oxidizer mixing passage 305 before the fuel/oxidizer mixture 384 egresses through the exit opening 311. The desired period of time may be based at least on a desired amount of vaporization, mixing, or both, or the fuel/oxidizer mixture 384 in the fuel/oxidizer mixing passage 305 before the fuel/oxidizer mixture 384 egresses through the exit opening 311. Additionally, or alternatively, the desired period of time may be based at least on mitigating auto-ignition of the fuel/oxidizer mixture 384 within the fuel injector 300. As such, in various embodiments, the outer sleeve 310, such as a portion of which defining the fuel/oxidizer mixing passage 305, may be elongated or shortened based at least on mitigating auto-ignition of the fuel/oxidizer mixture 384, or promoting a desired amount of vaporization and/or mixing, or combinations thereof.

Referring still to the exemplary embodiments of the fuel injector 300 generally provided in FIGS. 6-10, in various embodiments, the fuel conduit 319 is further defined through the first member 323 of the arm 320. For example, referring to FIGS. 9-10, the fuel conduit 319 may be defined generally circumferentially (e.g., along circumferential direction C3) through the outer sleeve 310, such as generally surrounding the plurality of grooves 315 radially inward of the fuel conduit 319. The fuel conduit 319 is further in fluid communication with the plurality of fuel injection openings 317 disposed in adjacent circumferential arrangement through the outer sleeve 310. The arm 320 may provide a flow of fuel, shown schematically by arrows 373, through the fuel conduit 319, and egressed into the fuel/oxidizer mixing passage 305 through the fuel injection openings 317. More specifically, the fuel injection openings 317 may egress the flow of fuel 373 to a shear mixing region 380, such as further described below.

In one embodiment, the second member 325 of the arm 320 defines a pressure atomizer 330 within the fuel passage 329. In various embodiments, the pressure atomizer may define a pressure swirl atomizer, a dual orifice atomizer, plain or air-assisted jets, or other suitable method(s) of fuel injection.

In another embodiment of the fuel injector 300, the outer sleeve 310 defines at least a portion of the inner diameter 307 at the plurality of grooves 315 as decreasing from the inlet opening 309 toward the downstream direction. In one embodiment, the inner diameter 307 of the outer sleeve 310 at the plurality of grooves 315 may decrease by approximately 33% or less at a downstream end 314 of the plurality of grooves 315 relative to an upstream end of the plurality of grooves 315 (e.g., most proximate to the inlet opening 309. In another embodiment, the inner diameter 307 of the outer sleeve 310 at the plurality of grooves 315 may decrease by approximately 25% or less at the downstream end 314 of the plurality of grooves 315 relative to an upstream end of the plurality of grooves 315. In still another embodiment, the inner diameter 307 of the outer sleeve 310 at the plurality of grooves 315 may decrease by approximately 15% or less at the downstream end 314 of the plurality of grooves 315 relative to an upstream end of the plurality of grooves 315. In still yet another embodiment, the inner diameter 307 of the outer sleeve 310 at the plurality of grooves 315 may decrease by approximately 7% or less at the downstream end 314 of the plurality of grooves 315 relative to an upstream end of the plurality of grooves 315.

In still another embodiment of the fuel injector 300, the radial opening 313 is defined through the outer sleeve 310 and is further disposed outward along the radial direction R3 of the downstream end 314 of the plurality of grooves 315. As such, the radial opening 313 provides a flow of oxidizer, shown schematically by arrows 382, therethrough inward along the radial direction R3. The flow of oxidizer 382 encounters a flow of fuel, shown schematically by lines, and region radially therewithin, 372. The flow of oxidizer 382 and the flow of fuel 372 are mixed in a region, schematically shown within region 380, within the fuel/oxidizer mixing passage 305 downstream of the plurality of grooves 315. For example, the radial inflow of the flow of oxidizer 382 into the fuel/oxidizer mixing passage 305 and the generally axial flow of fuel 372 toward the fuel/oxidizer mixing passage 305 together define a shear mixing zone at the region 380 downstream of the plurality of grooves 315.

A generally axial flow of oxidizer, shown schematically by arrows 383, may enter into the outer sleeve 310 via the inlet opening 309. The flow of oxidizer 383 is conditioned along the plurality of grooves 315 defined into the inner diameter 307 of the outer sleeve 310. The flow of oxidizer 383 may further aid fuel/oxidizer mixing at the shear mixing zone region 380 downstream of the plurality of grooves 315. The flows of oxidizer 382, 383 mixed with the flows of fuel 372, 373 together yield the fuel/oxidizer mixture 384 defining a relatively low swirl, high momentum flow through the fuel/oxidizer mixing passage 305 and egressed through the exit opening 311 into the combustion chamber 62, the primary flow passage 70, or both, of the combustor assembly 50 (FIGS. 1-5).

In various embodiments, the radial opening 313 is defined through the outer sleeve 310 and is further extended at least partially along the circumferential direction C3 or tangentially relative to the fuel injector centerline 13. As such, the radial inflow of the flow of oxidizer 382 through the outer sleeve 310 to the fuel/oxidizer mixing passage 305 defines, at least in part, an axial component (along the axial direction A3), a radial component (along the radial direction R3), and a circumferential component (along the circumferential direction C3) inward of the outer sleeve 310 and in the fuel/oxidizer mixing passage 305. In one embodiment, the radial opening 313 through the outer sleeve 310 is extended at least partially along the axial direction A3. The fuel injection opening 317 and the downstream end 314 of the plurality of grooves 315 are each defined inward of the radial opening 313 along the radial direction R3.

Figure 10:
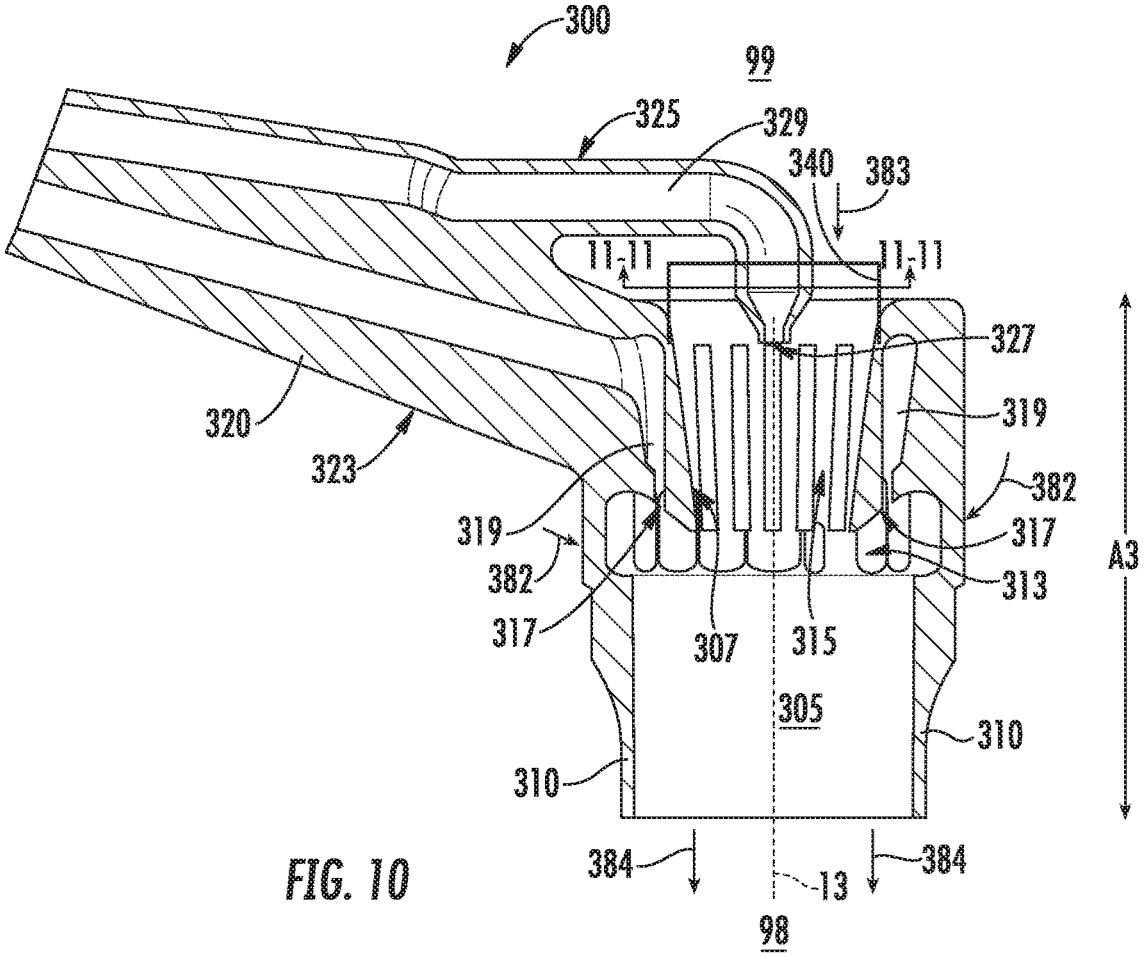
FIG. 10 is a cross sectional view of a portion of another exemplary embodiment of the fuel injector of FIG. 6.
Figure 11:
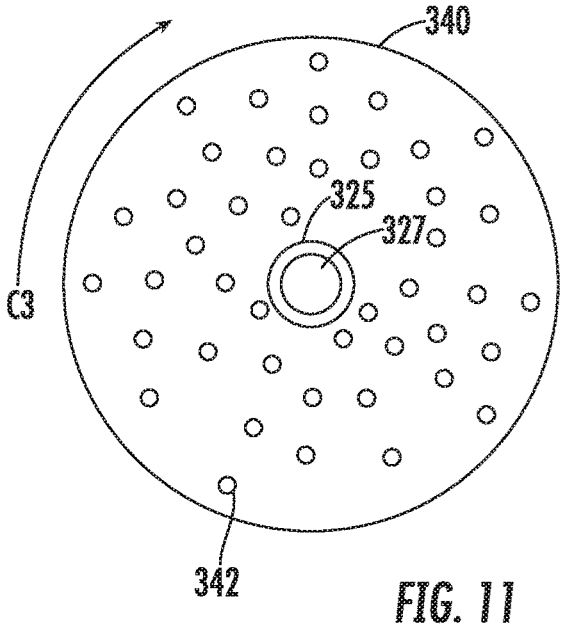
FIG. 11 is a cross sectional view of a portion of the exemplary fuel injector of FIG. 9 at plane 11-11.

Referring now to FIGS. 10-11, the fuel injector 300 may further include a forward wall 340 extended along the radial direction R3 between the outer sleeve 310 and the second member 325 of the arm 320. The forward wall 340 is generally concentric to the fuel injector centerline 13. The forward wall 340 defines a plurality of wall openings 342 therethrough. The flow of oxidizer 383 flows through the plurality of wall openings 342 to mix with the flow of fuel 372 egressing the fuel injection port 327.

The forward wall 340 may generally provide flow metering, control, or restriction of the flow of oxidizer 383 into the outer sleeve 310. For example, the plurality of fuel injectors 300 may define one or several forward walls 340 defining one or several wall openings 342. Each forward wall 340 may define wall openings 342 of various flow characteristics (e.g., cross sectional areas, shapes, volumes, surface finishes, etc.) to regulate or meter the flow of oxidizer 383 therethrough. As such, each fuel injector 300 may define different flow characteristics based at least in part on the forward wall 340. As another example, the primary fuel injector 210 may define a first forward wall 340, or none; the secondary fuel injector 220 may define a second forward wall 340; and the tertiary fuel injector 230 may define a third forward wall 340, in which each forward wall 340 defines the plurality of wall openings 342 of different flow characteristics for conditioning the flow of oxidizer 383 therethrough. As still another example, the wall opening 342 may be defined through the forward wall 340 such as extended at least partially in the circumferential direction C3 relative to the fuel injector centerline 13.

Various embodiments of the combustor assembly 50 and fuel injector 300 generally provided herein may be configured to flow a liquid fuel, a gaseous fuel, or combinations thereof. For example, in one embodiment, the fuel injector 300 may provide a liquid flow of fuel 372 through the fuel injection port 327 and a gaseous flow of fuel 373 through the fuel injection opening 317. In other embodiments, the fuel injector 300 may provide a liquid fuel through each of the fuel injection port 327 and the fuel injection opening 317. In still other embodiments, the fuel injector 300 may provide a gaseous fuel through each of the fuel injection port 327 and the fuel injection opening 317.

In still various embodiments of the fuel injector 300, the plurality of groves 315 may define surface finishes or features promoting flow of the oxidizer 383 into the shear mixing region 380. For example, the plurality of grooves 315 may define a rifled surface, such as defining spiral grooves, to promote high momentum of the flow of oxidizer 383. The outer sleeve 310 generally, such as the inner diameter 307 and/or portions along the fuel/oxidizer mixing passage 305, may define polished, super-polished, or rifled surfaces such as to promote flow of the fuel/oxidizer mixture 384.

All or part of the embodiments of the combustor assembly 50 and fuel injector 300 generally provided herein may be part of a single, unitary component and may be manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or any combination thereof may be utilized to construct the combustor assembly 50 or fuel injector 300 separately or integral to one or more other portions of the combustion section 26. Furthermore, the combustor assembly 50 may constitute one or more individual components that are mechanically joined (e.g. by use of bolts, nuts, rivets, or screws, or welding or brazing processes, or combinations thereof) or are positioned in space to achieve a substantially similar geometric, aerodynamic, or thermodynamic results as if manufactured or assembled as one or more components. Non-limiting examples of suitable materials include high-strength steels, nickel and cobalt-based alloys, and/or metal or ceramic matrix composites, or combinations thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel injector for a gas turbine engine, the fuel injector comprising:

an outer sleeve extended along at least partially co-directional to a fuel injector centerline, wherein an upstream end of the outer sleeve defines an inlet opening and a downstream end of the outer sleeve defines an exit opening, wherein each of the inlet opening and the exit opening are defined within the outer sleeve along a radial direction relative to the fuel injector centerline, and further wherein the outer sleeve defines a radial opening extended therethrough relative to the fuel injector centerline along the radial direction, and wherein at least a portion of an inner diameter of the outer sleeve defines a plurality of grooves extended from approximately the inlet opening, and further wherein the outer sleeve defines a fuel conduit through at least a portion of the outer sleeve outward of the plurality of grooves along the radial direction from the fuel injector centerline, and wherein the fuel conduit defines a fuel injection opening inward along the radial direction of the radial opening defined through the outer sleeve;

an arm coupled to the outer sleeve and extended along the radial direction relative to the fuel injector centerline, wherein the arm defines a first member coupled to the outer sleeve and a second member extended along the radial direction and contoured to define a fuel injection port generally concentric to the fuel injector centerline, and wherein the second member defines a fuel passage extended therethrough in fluid communication with the fuel injection port; and further comprising:

a forward wall extended along the radial direction between the outer sleeve and the second member of the arm, wherein the forward wall is generally concentric to the fuel injector centerline, and wherein the forward wall defines a plurality of wall openings therethrough.

2. The fuel injector of claim 1, wherein the second member of the arm defines a pressure atomizer within the fuel passage.

3. The fuel injector of claim 1, wherein the outer sleeve defines at least a portion of the inner diameter at the plurality of grooves as decreasing from the inlet opening toward the downstream direction.

4. The fuel injector of claim 1, wherein the radial opening defined through the outer sleeve is disposed outward along the radial direction of a downstream end of the plurality of grooves.

5. The fuel injector of claim 1, wherein the radial opening defined through the outer sleeve is extended at least partially along the circumferential direction relative to the fuel injector centerline.

6. The fuel injector of claim 1, wherein a fuel/oxidizer mixing passage is defined inward of the outer sleeve, and further wherein the fuel/oxidizer mixing passage is defined downstream of the plurality of grooves and upstream of the exit opening.

7. The fuel injector of claim 1, wherein the fuel conduit is further defined through the first member of the arm.

8. The fuel injector of claim 1, wherein the radial opening through the outer sleeve is extended at least partially along an axial direction relative to the fuel injector centerline, and wherein the fuel injection opening and a downstream end of the plurality of grooves are each defined inward of the radial opening along the radial direction.

9. The fuel injector of claim 1, wherein the wall opening is defined through the forward wall extended at least partially in the circumferential direction relative to the fuel injector centerline.

10. A gas turbine engine defining an axial engine centerline, the gas turbine engine comprising:

a combustion section defined generally concentric to the engine centerline, wherein the combustion section comprises a plurality of fuel injectors defines in adjacent circumferential arrangement around the engine centerline, wherein the fuel injector comprises:

an at least partially cylindrical outer sleeve extended along a circumferential direction relative to a fuel injector centerline and at least partially co-directional to the fuel injector centerline, wherein an upstream end of the outer sleeve defines an inlet opening and a downstream end of the outer sleeve defines an exit opening, wherein each of the inlet opening and the exit opening are defined within the outer sleeve along a radial direction relative to the fuel injector centerline, and further wherein the outer sleeve defines a radial opening extended therethrough relative to the fuel injector centerline along the radial direction, and wherein at least a portion of an inner diameter of the outer sleeve defines a plurality of grooves extended from approximately the inlet opening, and further wherein the outer sleeve defines a fuel conduit through at least a portion of the outer sleeve outward of the plurality of grooves along the radial direction from the fuel injector centerline, and wherein the fuel conduit defines a fuel injection opening inward along the radial direction of the radial opening defined through the outer sleeve; and an arm coupled to the outer sleeve and extended along the radial direction relative to the fuel injector centerline, wherein the arm defines a first member coupled to the outer sleeve and a second member extended along the radial direction and contoured to define a fuel injection port generally concentric to the fuel injector centerline, and wherein the second member defines a fuel passage extended therethrough in fluid communication with the fuel injection port; and wherein the fuel injector further comprises:

a forward wall extended along the radial direction between the outer sleeve and the second member of the arm, wherein the forward wall is generally concentric to the fuel injector centerline, and wherein the forward wall defines a plurality of wall openings therethrough.

11. The gas turbine engine of claim 10, wherein the second member of the arm of the fuel injector defines a pressure atomizer within the fuel passage.

12. The gas turbine engine of claim 10, wherein the outer sleeve of the fuel injector defines at least a portion of the inner diameter at the plurality of grooves as decreasing from the inlet opening toward the downstream direction.

13. The gas turbine engine of claim 10, wherein a fuel/oxidizer mixing passage is defined inward of the outer sleeve, and further wherein the fuel/oxidizer mixing passage is defined downstream of the plurality of grooves and upstream of the exit opening.

14. The gas turbine engine of claim 10, wherein the radial opening through the outer sleeve of the fuel injector is extended at least partially along an axial direction relative to the fuel injector centerline, and wherein the fuel injection opening and a downstream end of the plurality of grooves are each defined inward of the radial opening along the radial direction.

15. The gas turbine engine of claim 10, wherein the wall opening is defined through the forward wall of the fuel injector is extended at least partially in the circumferential direction relative to the fuel injector centerline.

16. The gas turbine engine of claim 10, wherein the combustion section defines a trapped vortex combustor assembly.

17. The gas turbine engine of claim 10, wherein the plurality of fuel injectors are disposed at least partially in a circumferential direction relative to the engine centerline.

18. The gas turbine engine of claim 10, wherein the plurality of fuel injectors are disposed at least partially in a radial direction relative to the engine centerline.

* * * * *